US006999047B1

(12) United States Patent
Holtslag

(10) Patent No.: US 6,999,047 B1
(45) Date of Patent: Feb. 14, 2006

(54) DISPLAYING VIDEO ON A PLASMA DISPLAY PANEL

(75) Inventor: Antonius H. M. Holtslag, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/268,254

(22) Filed: Mar. 15, 1999

(30) Foreign Application Priority Data

Aug. 12, 1998 (EP) ..... 98202702

(51) Int. Cl.
*G09G 3/28* (2006.01)

(52) U.S. Cl. ..... 345/60; 345/63; 345/67

(58) Field of Classification Search ..... 345/60, 345/67, 68, 7, 55, 63, 100, 103, 204, 214, 345/501; 348/448, 797; 349/446, 448, 558, 349/793

See application file for complete search history.

(56) References Cited

U.S. PATENT DOCUMENTS 4,266,240 A * 5/1981 Levy ..... 348/43
4,286,286 A * 8/1981 Jurisson et al. ..... 348/56
4,287,528 A * 9/1981 Levy ..... 348/43
4,562,463 A * 12/1985 Lipton ..... 348/56
4,736,246 A * 4/1988 Nishikawa ..... 348/56
5,026,151 A * 6/1991 Waltuck et al. ..... 351/246
5,416,523 A * 5/1995 Murakami et al. ..... 348/420.1
5,420,602 A 5/1995 Kanazawa ..... 345/67
5,436,634 A 7/1995 Kanazawa ..... 345/67
5,748,165 A * 5/1998 Kubota et al. ..... 345/96
5,777,631 A * 7/1998 Greene et al. ..... 345/546
5,798,788 A * 8/1998 Meehan et al. ..... 348/180
5,898,414 A * 4/1999 Awamoto et al. ..... 345/55

FOREIGN PATENT DOCUMENTS

EP 0549275 B1 6/1993

* cited by examiner

*Primary Examiner*—Amr A. Awad
*Assistant Examiner*—Vincent E. Kovalick
(74) *Attorney, Agent, or Firm*—Edward W. Goodman

(57) ABSTRACT

A method of displaying a video signal (Vs) with m video lines in a video field period on a plasma display panel (1) which has n display lines (Di), includes selecting (2) the n display lines (Di) in an interlaced way to subsequently select a first and a second field of n/2 display lines (Di) to display an interlaced video signal (Vs). For displaying a progressive video signal (Vs), the m video lines are alternately displayed (3) on the first field of display lines (Di) only, or on the second field of display lines (Di) only, both during respective time periods which are longer than the video field period.

4 Claims, 4 Drawing Sheets

DISPLAYING VIDEO ON A PLASMA DISPLAY PANEL

BACKGROUND OF THE INVENTION

1. Field of the Invention

The invention relates to a method of displaying a video signal on a plasma display panel having a first and a second display field of display lines, the display lines (Di) of the first display field being in an interlaced position with respect to the display lines (Di) of the second display field. The invention further relates to a circuit for displaying a video signal on such a plasma display panel. The invention also relates to a plasma display device comprising such a plasma display panel and such a circuit for displaying a video signal on the plasma display panel.

2. Description of the Related Art

In a known Alternate Lighting In Surface Plasma Display Panel (further referred to as ALIS PDP) with n display lines, each display line comprises a plasma channel with which two spaced-apart select electrodes are aligned. Two consecutive plasma channels have one select electrode in common. The display lines are selected in an interlaced sequence so as to be able to select all display lines of this ALIS PDP one by one. First, during a first display field of display lines, the n/2 odd display lines are selected one by one, then, during a second display field of display lines, the n/2 even lines are selected one by one.

An interlaced video signal has a frame period with a first and a second video field period. Usually, the odd lines of the video signal form the first video field, and the even lines of the video signal form the second video field. When this interlaced video signal has to be displayed on the ALIS PDP, the odd lines of the video signal are displayed on the odd display lines, and the even lines of the video signal are displayed on the even display lines.

When a progressive video signal has to be displayed on the ALIS PDP, two approaches are known, dependent on the number of video lines to be displayed. When the number of video lines to be displayed is substantially equal to the number of display lines, the odd lines of the video signal are displayed on the odd display lines. Thus, the even lines of the video signal are not used, and the odd display lines are selected also in periods during which otherwise the even display lines would be selected. When the number of video lines is substantially equal to half the number of display lines, all the lines of the video signal are displayed on the odd display lines only.

In the situation where interlaced video (for example, HDTV) as well as progressive video (for example, SXGA) is displayed on the ALIS PDP, the display of the interlaced video becomes different for the odd and the even display lines.

SUMMARY OF THE INVENTION

It is, inter alia, an object of the invention to reduce the differences in the display of the odd and the even display lines.

To this end, a first aspect of the invention provides a method of displaying a video signal on a plasma display panel described above, the method comprising the steps of alternately selecting several times the first display field only, or the second display field only, both during respective time periods which are longer than the video field period; and supplying video data signals in conformance with the video lines to the display lines of the selected display field.

A second aspect of the invention provides a circuit for displaying a video signal on a plasma display panel as described above, the circuit comprising means for alternately selecting several times the first display field only, or the second display field only, both during respective time periods which are longer than the video field period; and means for supplying video data signals in conformance with the video lines to the display lines of the selected display field.

A third aspect of the invention provides a plasma display device including a plasma display panel as described above, with a circuit for displaying a video signal on the plasma display panel as described above.

The invention is based on the recognition that the display of progressive video on the odd display lines only, as performed in the prior art, causes the phosphors of the odd display lines to age at a faster rate than the phosphors of the even display lines. According to the invention, the progressive video is alternately displayed on the odd display lines only, or on the even display lines only. In both situations, this is done during a certain period of time which is larger than a field period of the video signal. For example, the period of time is one hour. In this way, the phosphors of the odd and even display lines will age substantially equally and the artifacts during display of the interlaced video signal on all display lines decrease.

In an embodiment of the invention, the number of video lines is smaller than or substantially equal to half the number of display lines. In this way, only a few or no video lines will not be displayed on the display lines.

In another embodiment of the invention, the period of time during which the video signal is displayed on the odd or even lines only, is sufficiently large to prevent line flicker.

These and other aspects of the invention will be apparent from and elucidated with reference to the embodiments described hereinafter.

DESCRIPTION OF THE PREFERRED EMBODIMENTS

Figure 1:
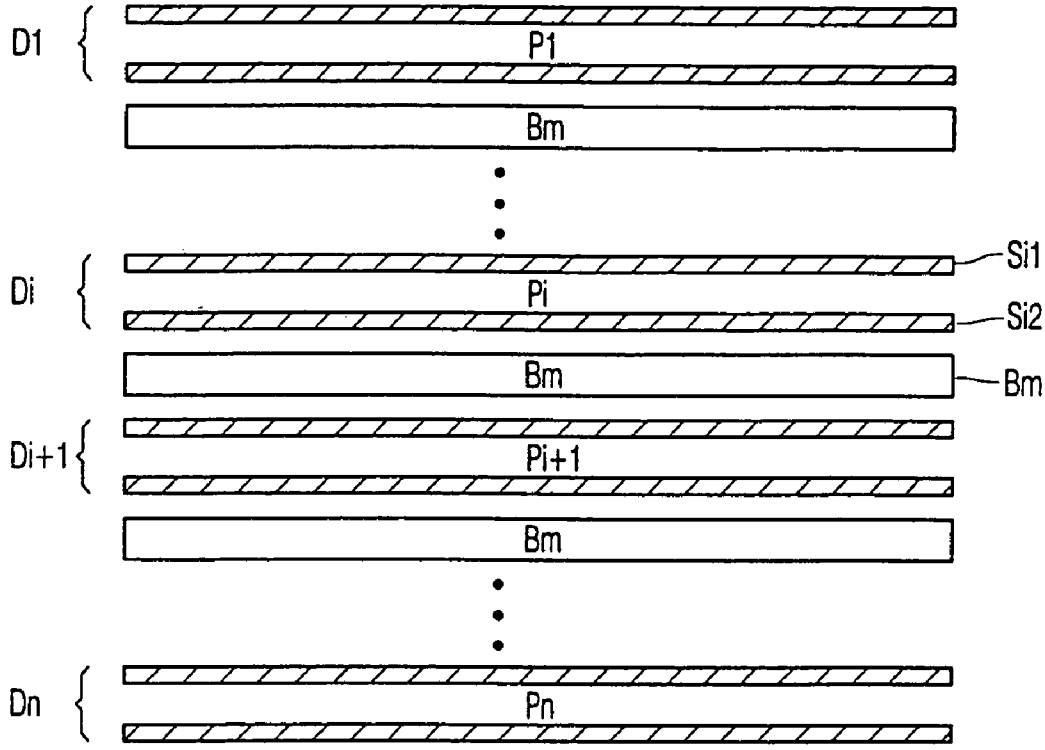
FIG. 1 shows part of the structure of a known progressively scanned PDP.

FIG. 1 shows part of the structure of a known progressively scanned PDP with n display lines D1, . . . , Dn. Each display line Di comprises a plasma channel Pi with which two spaced-apart select electrodes Si1, Si2 are aligned. A display line Di is selected to prime associated pixels Cij (see FIG. 3) by supplying a sufficiently high voltage between the two electrodes Si1, Si2. A line of black matrix material Bm separates two consecutive plasma channels Pi, Pi+1.

Because two select electrodes Si1, Si2 are associated with one plasma channel Pi only, it is possible to activate neighboring plasma channels Pi independently. This provides a progressive scan of the plasma channels Pi whereby the plasma channels Pi are activated successively one by one. Detailed information on such a PDP panel and the driving thereof can be found in European Patent Application EP-B-

0549275, corresponding to U.S. Pat. No. 5,420,602, which is herein incorporated by reference.

Figure 2:
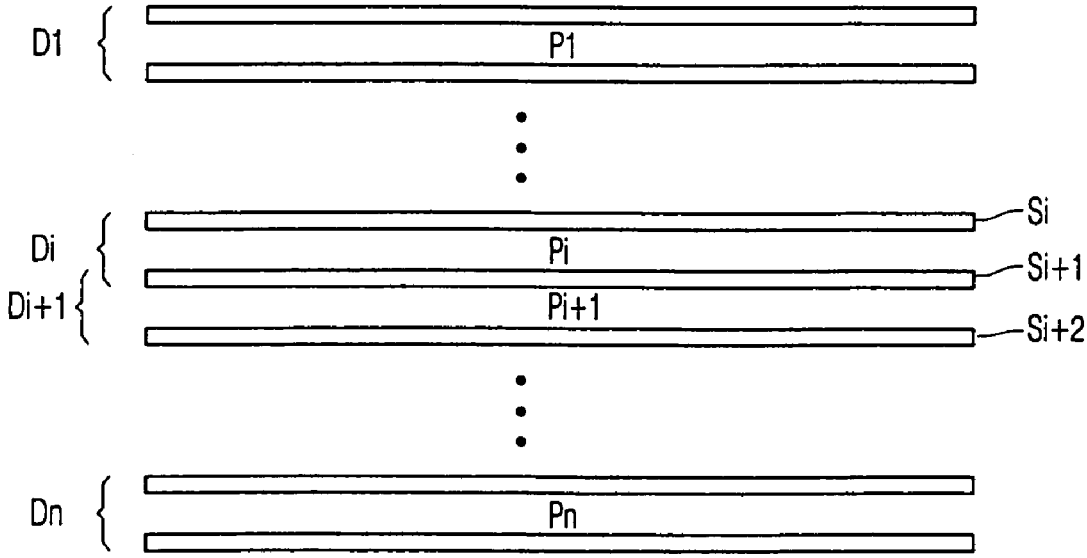
FIG. 2 shows part of the structure of the known ALIS PDP.

FIG. 2 shows part of the structure of the known ALIS PDP. In the ALIS PDP with n display lines D1, . . . , Dn, each display line Di comprises a plasma channel Pi with which two spaced-apart select electrodes Si, Si+1 are aligned. Again, a display line Di is selected by supplying a sufficiently high voltage between the two electrodes Si, Si+1. Two consecutive plasma channels Pi, Pi+1 have one electrode Si+1 in common. The display lines Di are selected in an interlaced sequence to provide a one-by-one selection of all display lines Di of this ALIS PDP. First, during a first field of display lines Di, the n/2 odd display lines Di are selected one by one, then, during a second field of display lines Di, the n/2 even display lines Di are selected one by one.

The addressing of the ALIS PDP is elucidated with respect to FIG. 3 and FIGS. 4A–4D.

Figure 3:
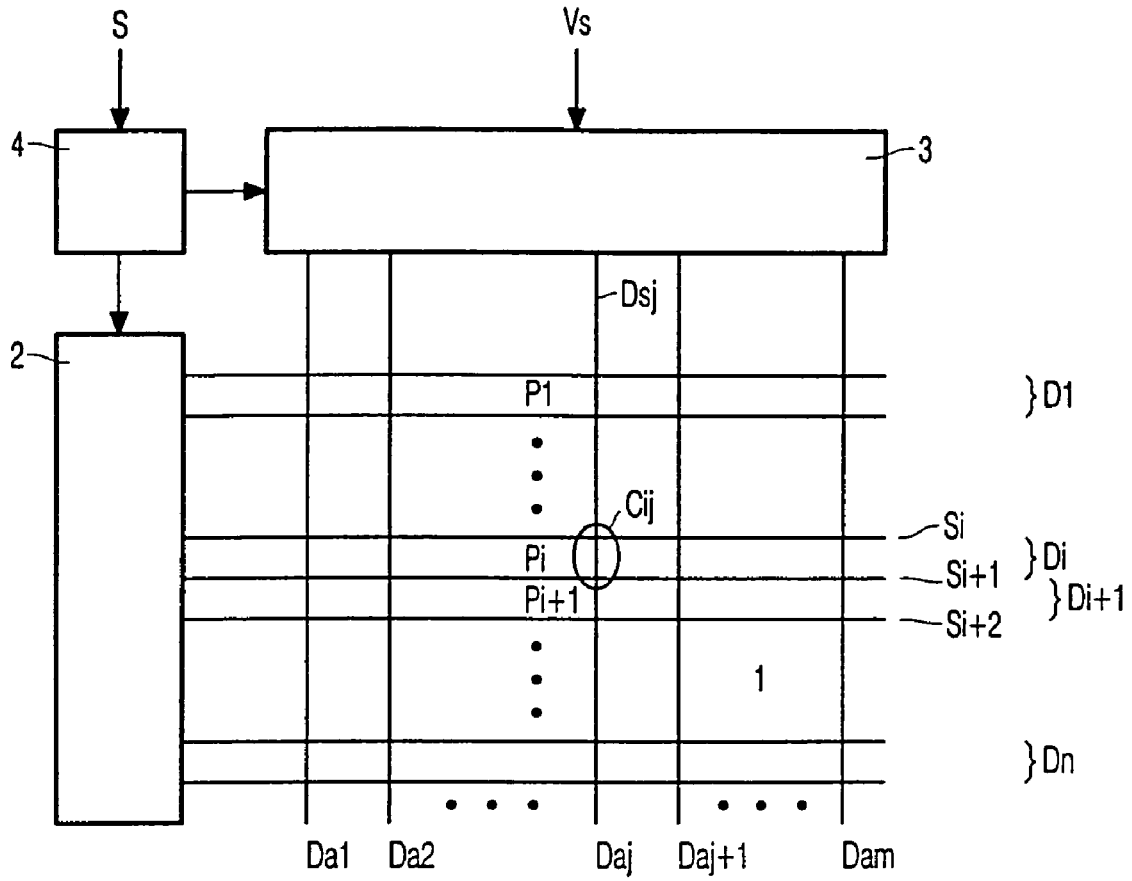
FIG. 3 shows a block diagram of a circuit for displaying a video signal on the known ALIS PDP.

FIG. 3 shows a block diagram of a circuit for displaying a video signal Vs on the known ALIS PDP 1. The ALIS PDP 1 shown comprises plasma channels Pi extending in the horizontal direction. Two select electrodes Si, Si+1 are associated with each plasma channel Pi. Data electrodes Daj extend in the vertical direction. Overlapping regions of the plasma channels Pi and the data electrodes Daj form display cells or pixels Cij one of which is indicated by a circle.

It is known to generate the gray scales of the displayed video by driving the PDP in a sub-field mode. During each display field, a number of sub-fields is generated, each sub-field comprising a prime period and a sustain period. During the prime period, a select driver 2 selects the display lines (rows) Di one by one to prime the display cells Cij of the selected row Di with data signals Dsj. A data driver 3, which receives the video signal Vs, supplies the data signals Dsj in parallel. During the sustain period, the select driver 2 supplies pulses to all the rows Di associated with the active display field. The plasma channels Pi are ignited a predetermined number of times to generate light from the pixels Cij primed to do so. The amount of light produced depends on the number of ignitions. Sustain periods with a different number of ignitions are associated with the different sub-fields in a display field period. The amount of light generated during a display field is the sum of the different amounts of light produced during the sub-fields of this display field. The PDP is able to produce gray scales because, during the priming period of each sub-field, it is possible to select whether a certain pixel has to produce light during the subsequent sustain period or not. Each sub-field may comprise an erase period, or the erase period may occur once in a display field. During the erase period, all pixels associated with the display field are erased. Detailed information on the sub-field operation of a PDP can be found in EP-B-0549275.

The timing circuit 4 receives the horizontal and vertical synchronization signals S of the video signal Vs to produce the timing signals for the select driver 2 and the data driver 3.

When a progressive video signal Vs has to be displayed on the ALIS PDP, two approaches are known, dependent on the number of video lines to be displayed. When the number of video lines to be displayed is substantially equal to the number of display lines Di, only the odd lines of the video signal Vs are displayed on only the odd display lines Di. Thus, the even lines of the video signal Vs are not displayed, and the odd display lines Di are selected also in periods during which otherwise the even display lines Di would be selected. When the number of video lines is substantially equal to half the number of display lines Di, all the lines of the video signal Vs are displayed on the odd display lines Di only. The timing circuit 4 commands the select driver 2 to only select the lines of the odd field of display lines Di. The timing circuit 4 may receive information indicating the display mode, or the timing circuit 4 may detect the type of video signal Vs by evaluating the horizontal and vertical synchronization signal of the video signal Vs.

According to the invention, the progressive video Vs is displayed alternately on the odd display lines Di only, or on the even display lines Di only. In both situations, this is done during a certain period of time which is larger than a field period of the video signal Vs. For example, the certain period of time may be one hour, or the certain period of time may be related to the time the display is active. When the display is switched on to normal operation after it has been switched off or entered a standby mode, the video signal Vs is displayed on the other field of display lines Di. The timing circuit 4 may comprise a timer or a memory device, respectively, to generate the certain period in time. The timing circuit 4 commands the select driver 2 to only select the display lines Di of the odd field of display lines, or to only select the display lines Di of the even field of display lines.

FIGS. 4A–4D show voltages supplied to the select electrodes Si of the ALIS PDP to obtain an interlaced scan. In all FIGS. 4A–4D, voltages are denoted by a number 0, 1, −1, −2 to indicate the polarity and the relative value of the voltage concerned. For the sake of simplicity, an ALIS PDP with only a few select electrodes Si (S1 to S12), data electrodes Daj (Da1 to Da6) and display lines D1, . . . , D11 is shown. The voltages supplied to the odd select electrodes S1, S3, . . . , S11 are shown to the left of the PDP. The even select electrodes S2, S4, . . . , S12 are interconnected in two groups, the voltages supplied to these groups are shown to the right of the PDP. The data voltages Dsj are shown below the PDP. In a selected display line Di, Pixels Cij which are primed to generate light are indicated by a solid circle, pixels Cij which are primed to not produce light are indicated by a dashed circle.

Figure 4A:
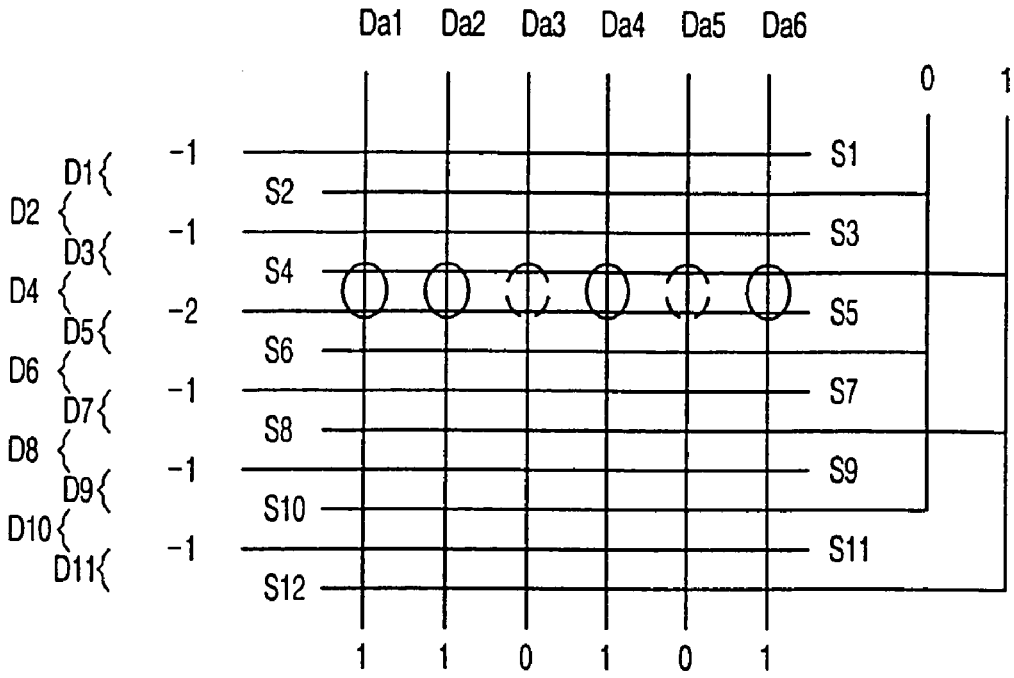
FIGS. 4A–4D show voltages supplied to the select electrodes of the ALIS PDP to obtain an interlaced scan.
Figure 4B:
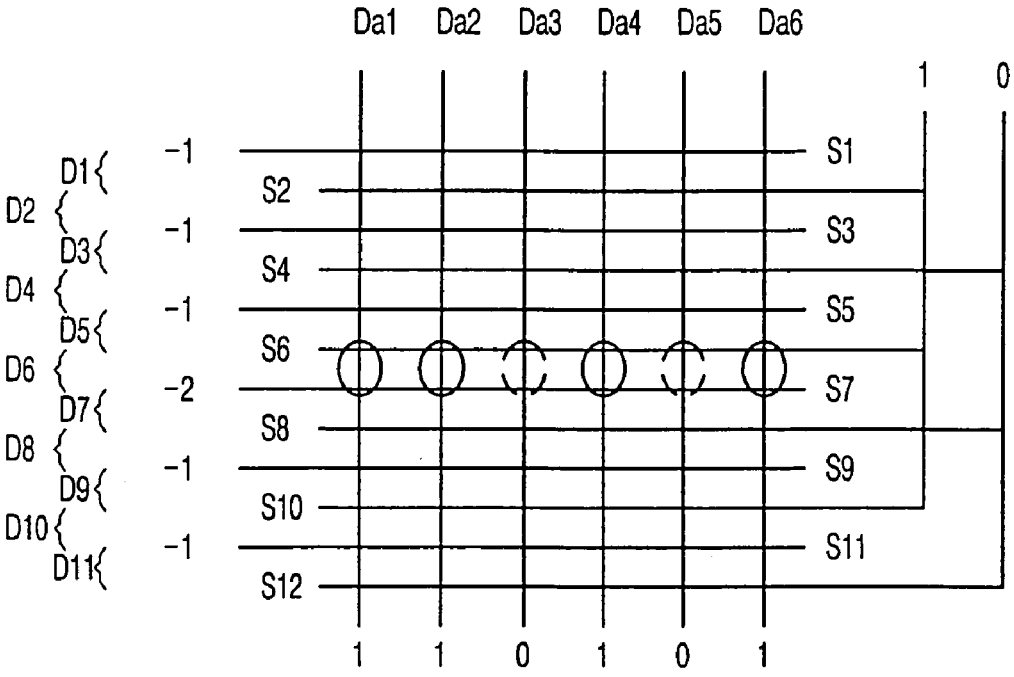
Figure 4C:
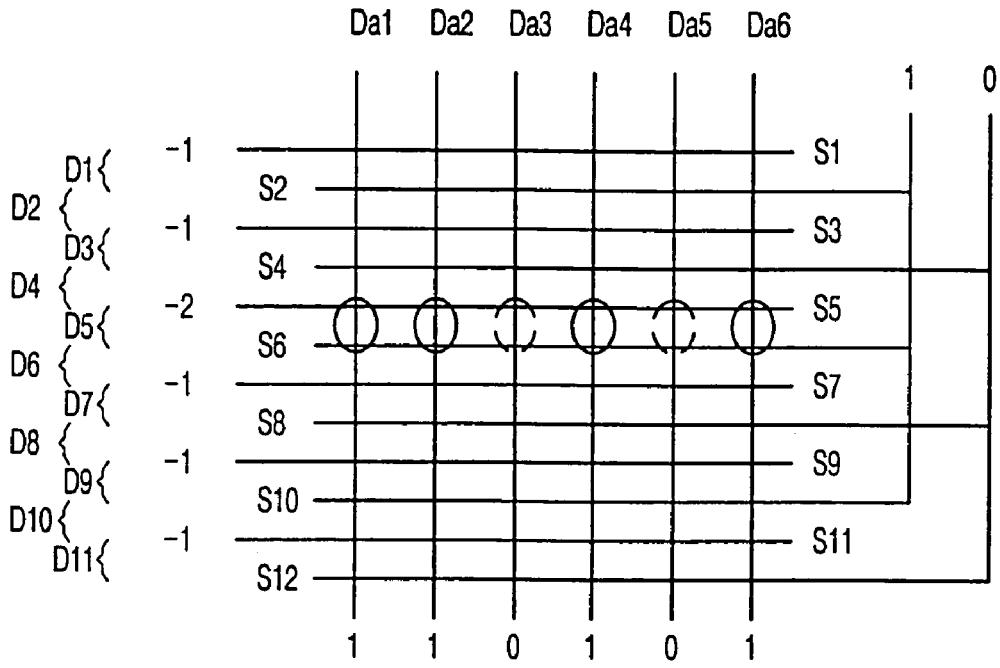
Figure 4D:
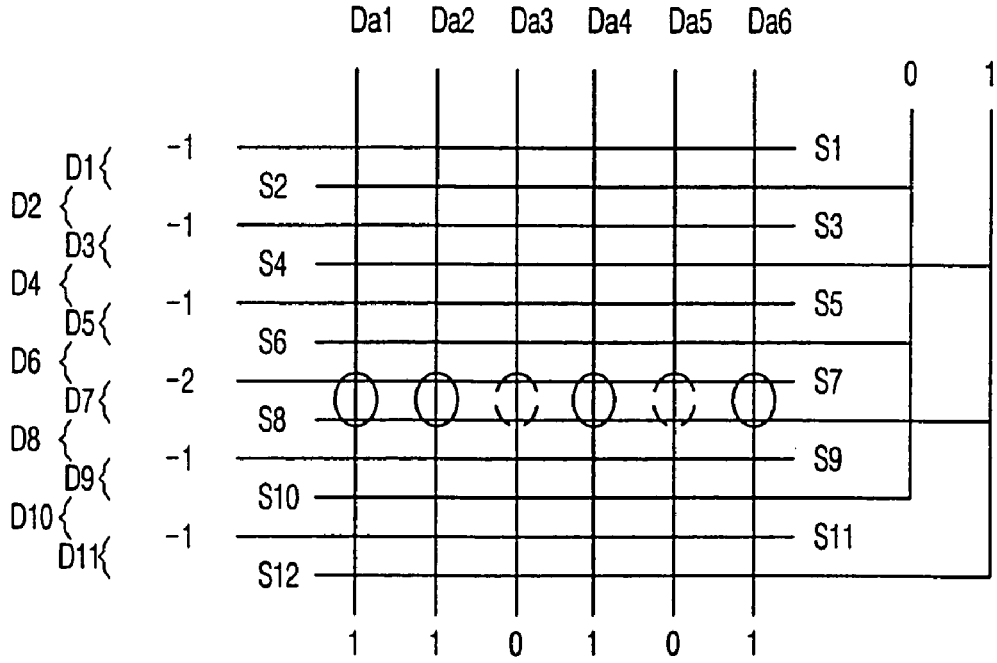

FIG. 4A shows the voltages to select display line D4 during a certain display field. FIG. 4B shows the voltages to select display line D6 during the same display field. FIG. 4C shows the voltages to select display line D5 during a succeeding display field, and FIG. 4D shows the voltages to select display line D7 during this succeeding field.

It is possible to select the display lines Di of a certain display field in different ways. As an example, this is explained with respect to FIGS. 4A and 4B. All even rows D2, D4, . . . , D10 may be selected one by one by first selecting a certain row, let us assume D4, in accordance with FIG. 4A. Next, the consecutive even row D6 is selected as shown in FIG. 4B. Then, the even row D8 is selected in accordance with FIG. 4A by applying a −1 voltage to select electrode S5 and a −2 voltage to select electrode S9. Next, the even row D10 is selected in accordance with FIG. 4B by applying a −1 voltage to select electrode S7 and a −2 voltage to the select electrode S11. And so on. This selection scheme has the disadvantage that the voltages on the even select electrodes have to change for every display line Di, which causes a large dissipation. This drawback is prevented by first selecting the rows D4, D8 in accordance with FIG. 4A and next the rows D2, D6, D10 in accordance with FIG. 4B. In the same way, it is possible to select the odd display rows Di first in accordance with FIG. 4C and next in accordance with FIG. 4D.

It should be noted that the above-mentioned embodiments illustrate rather than limit the invention, and that those skilled in the art will be able to design many alternative embodiments without departing from the scope of the appended claims. The embodiments describe an ALIS PDP with plasma channels extending in the horizontal direction. Alternatively, the PDP may be rotated through 90°, such that the plasma channels extend in the vertical direction. The plasma channels may be open towards each other, such that a layer of plasma exists. Instead of plasma channels, the PDP may comprise plasma cells.

An aspect of the invention is defined in a method of displaying a video signal Vs with m video lines in a video field period on a plasma display panel 1 having n display lines Di. The n display lines Di are selected (2) in an interlaced way to subsequently select a first and a second field of n/2 display lines Di to display an interlaced video signal Vs. For displaying a progressive video signal Vs, the m video lines are alternately displayed (3) on the first field of display lines Di only, or on the second field of display lines Di only, both during respective time periods which are longer than the video field period.

In the claims, the word "comprising" does not exclude the presence of other elements or steps than those listed in a claim. The invention can be implemented by means of hardware comprising several distinct elements, and by means of a suitably programmed computer. In the device claim enumerating several means, several of these means can be embodied by one and the same item of hardware.

What is claimed is:

1. A method of displaying a video signal with video lines in a video field period on a plasma display panel having a first and a second display field of display lines, the display lines of the first display field being in an interlaced position with respect to the display lines of the second display field, the method comprising the steps:

alternately selecting the first display field only for a first time period lasting longer than the video field period, and then the second display field only for a second time period lasting longer than the video field period; and supplying, for each video field period, the video lines of the video signal to the display lines of the selected display field, wherein the respective time periods are substantially longer than the video field period.

2. The method as claimed in claim 1, characterized in that the number of video lines in a video field period is smaller than or substantially equal to the number of display lines of the first or second display field.

3. A circuit for displaying a video signal with video lines in a video field period on a plasma display panel having a first and a second display field of display lines, the display lines of the first display field being in an interlaced position with respect to the display lines of the second display field, the circuit comprising:

means for alternately selecting the first display field only for a first time period lasting longer than the video field period, and then the second display field only for a second time period lasting longer than the video field period; and means for supplying, for each video field period, the video lines of the video signal to the display lines of the selected display field, wherein the respective time periods are substantially longer than the video field period.

4. A plasma display device comprising a plasma display panel and a circuit for displaying a video signal with video lines in a video field period on a plasma display panel having a first and a second display field of display lines, the display lines of the first display field being in an interlaced position with respect to the display lines of the second display field, the circuit comprising:

means for alternately selecting the first display field only for a first time period lasting longer than the video field period, and then the second display field only for a second time period lasting longer than the video field period; and means for supplying, for each video field period, the video lines of the video signal to display lines of the selected display field, wherein the respective time periods are substantially longer than the video field period.

* * * * *